US007714511B2

(12) United States Patent
Mizojiri et al.

(10) Patent No.: US 7,714,511 B2
(45) Date of Patent: May 11, 2010

(54) EXCIMER LAMP HAVING UV-REFLECTING FILM

(75) Inventors: Takafumi Mizojiri, Himeji (JP); Satoshi Matsuzawa, Himeji (JP); Shigeki Fujisawa, Himeji (JP); Yukihiro Morimoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 43 days.

(21) Appl. No.: 12/248,396

(22) Filed: Oct. 9, 2008

(65) Prior Publication Data

US 2009/0096377 A1 Apr. 16, 2009

(30) Foreign Application Priority Data

Oct. 11, 2007 (JP) ..... 2007-265350

(51) Int. Cl.
*H01J 61/35* (2006.01)
*H01J 65/00* (2006.01)

(52) U.S. Cl. ..... 313/635; 313/113; 313/607

(58) Field of Classification Search ..... 313/635, 313/113, 607, 234, 489
See application file for complete search history.

(56) References Cited

U.S. PATENT DOCUMENTS 6,525,451 B1 * 2/2003 Hishinuma et al. ..... 313/234
2002/0101145 A1 * 8/2002 Hildenbrand et al. ..... 313/112
2005/0073240 A1 * 4/2005 Mayer et al. ..... 313/489
2005/0242702 A1 * 11/2005 Justel et al. ..... 313/489
2006/0001353 A1 * 1/2006 Zeng et al. ..... 313/487
2006/0038507 A1 2/2006 Lee et al.

FOREIGN PATENT DOCUMENTS

JP 2-257562 A 10/1990
JP 6-338300 A 12/1994
JP 2000-200690 A 7/2000
JP 3580233 B2 7/2004

* cited by examiner

*Primary Examiner*—Karabi Guharay
(74) *Attorney, Agent, or Firm*—David S. Safran; Roberts Mlotkowski Safran & Cole, P.C.

(57) ABSTRACT

An excimer lamp which can emit UV radiation with a high degree of efficiency and high degree of uniformity, has a UV-reflecting film that does not peel. The excimer lamp is fitted with a silica glass discharge vessel that encloses a discharge gas which forms excimer molecules by dielectric barrier discharge in an internal space enclosed by a top wall panel, a bottom wall panel, side wall panels and end panels and with an electrode on both the outer surface of the top wall panel and another electrode on the outer surface of the bottom wall panel. On the inner surface of the discharge vessel, a UV-reflecting film comprised of silica and alumina particles is formed, at least, on the inner surface area of the side wall panels with the silica particles composing at least 30 weight % of the UV-reflecting film.

4 Claims, 4 Drawing Sheets

EXCIMER LAMP HAVING UV-REFLECTING FILM

BACKGROUND OF THE INVENTION

1. Field of Invention

This invention relates to excimer lamps that emit UV radiation; more precisely, it relates to excimer lamps in which a UV-reflecting film is formed on the inner surfaces of a discharge vessel facing the discharge space.

2. Description of Related Art

Heretofore, excimer lamps have been employed as UV light sources for surface finishing when performing such processes as cleaning, ashing or coating by irradiation with UV radiation in, for example, the manufacturing of semiconductor devices, liquid crystal displays, etc.

In such an excimer lamp, the technology of installing a UV-reflecting film on the inner surface facing the discharge space of the discharge vessel has been proposed as a means of emitting highly efficient UV radiation (see, JP 3580233 B2, for example). In an excimer lamp with a structure like this one, in which a UV-reflecting film is installed on the inner surface of its discharge vessel, a light exit window for emitting UV radiation generated in the discharge space inside said discharge vessel is formed by an area where no UV-reflecting film is formed on part of the inner surface of the discharge vessel.

Moreover, in this kind of excimer lamp, when UV radiation generated inside the discharge vessel is radiated in other directions besides the direction facing the light exit window, it can be emitted from the light exit window together with the UV radiation directly radiated onto the light exit window by being reflected by the UV-reflecting film and therefore, the UV radiation can be emitted with high efficiency.

The UV-reflecting film on an excimer lamp consists of UV scattering particles having a high rate of UV scattering and these UV scattering particles have a laminated structure. Particles of such substances as silica, alumina, magnesium fluoride, calcium fluoride, lithium fluoride and magnesium oxide are employed as UV scattering particles in the UV-reflecting film.

When UV radiation hit this kind of body UV-reflecting film composed of laminated UV scattering particles, it is scattered in a direction which is different from the initial direction of the UV radiation by being refracted or reflected on the surfaces of numerous UV scattering particles.

On the other hand, silica glass is widely employed as the material for discharge vessels in lamps that emit UV radiation, such as an excimer lamp.

As shown in FIGS. 10 & 11, some types of excimer lamps are constructed in such a way that both ends are hermetically sealed and are provided with a nearly cylindrically shaped silica glass discharge vessel 20 inside of which is a discharge space S, and the outside of which are a top wall panel 21, bottom wall panel 23, side wall panels 25 and end wall panels 26 which enclose the discharge space S which contains the discharge gas. On each of the outer surfaces 21A and 23A of the facing top and bottom wall panels 21, 23, an electrode 11 and another electrode 12 are installed opposite from each other. In this excimer lamp, the UV-reflecting film 50 is formed on the inner surface 21B of top wall panel 21 on which one of the electrodes 11 is formed and also, a light exit window for emitting UV radiation generated in the discharge space S through an area where there no UV reflective coating 50 is formed on the inner surface of the discharge vessel 20 (specifically, the inner surface 23B of the bottom wall panel 23 and the inner surface 25A of the side wall panel 25. In FIG. 10, 28 is a chip tube and 29 is a flange.

In this type of excimer lamp, when high frequency voltage is applied between the electrodes 11, 12, the discharge vessel 20 and the UV-reflecting film 50 function as a dielectric body and, in discharge space S, a discharge starting point is generated on the surface facing discharge space S on the UV-reflecting film 50 and the bottom wall panel 23 facing the UV-reflecting film 50 (specifically, the surface 51 of the UV-reflecting film and the inner surface 23B of the bottom wall panel 23), and as a result, dielectric barrier discharge occurs and through this dielectric barrier discharge, excimer molecules are formed in the discharge gas and UV radiation is emitted from the light exit window comprised of the bottom wall panel 23 and the side wall panels 25 of the discharge vessel 20.

Nevertheless, as shown in FIG. 12, when the excimer lamp is turned on, there may be abnormal discharges (a) from the end area 55 of the UV-reflecting film 50 and, when the abnormal discharge occurs, a problem arises, since unevenness in illuminance occurs on the target surface of the target body, the target surface cannot be irradiated uniformly and the discharge energy consumption balance of the entire excimer lamp is destroyed.

In other words, in an excimer lamp, if there is no occurrence of abnormal discharge (a), a countless number of column-shaped discharges (hereafter referred to as "columnar arc discharges") (b) are almost uniformly generated at an identical discharge power in the discharge space (S), but if abnormal discharge (a) occurs, the discharge energy will be consumed by this abnormal discharge (a), so around the peripheral area of the area where said abnormal discharge (a) occurs, the discharge power of the columnar arc discharge (b) is low. Therefore, in the area where abnormal discharge (a) occurs, the discharge power of the UV radiation is lower and, as a result, on the target surface of the target body, the illuminance of the area where abnormal discharge (a) occurs is lower than for other areas.

In the example in FIG. 12, in one end area 55 (right end area) of the UV-reflecting film 50 in the excimer lamp, abnormal discharge (a) occurs, and therefore, in this excimer lamp, the light intensity where end area 55 is located is less than that of other areas.

Also, a problem arises in excimer lamps when, due to this arc discharge (a), peeling occurs at the end area 55 of the UV-reflecting film 50.

SUMMARY OF THE INVENTION

Given the above considerations, a primary object of this invention is to devise an excimer lamp that can produce UV irradiation with high efficiency, and moreover, can irradiate the target surface of a target body with a high rate of uniformity in addition to having a UV-reflective layer that does not peel.

This object is achieved by an excimer lamp in accordance with the present invention by the lamp being comprised of a top wall panel and a bottom wall panel facing said top wall panel, and a pair of side wall panels connecting said top wall panel and bottom wall panel and a pair of end wall panels connecting these top, bottom and pair of side wall panels respectively and, in the internal space enclosed by the top, bottom, side and end wall panels, a silica glass discharge vessel containing the discharge gas which forms the excimer molecules by dielectric barrier discharge, and in the excimer lamp which has an electrode formed on the outer surface of the top wall panel and another electrode formed on the outer surface of the bottom wall panel installed opposite each other on said discharge vessel and, on the inner surface of the above-mentioned discharge vessel, a UV-reflecting film comprised of silica particles and alumina particles is at least formed on the inner surface area of the side wall panel, with a percentage of silica particles of 30 weight % or more.

In this excimer lamp of the invention, it is preferable that the UV-reflecting film on the inner surface of the discharge vessel be formed on the inner surface of the discharge vessel including the inner surface area of the side wall panels which extends between the area from the electrode edge, corresponding to the location where the edge of one electrode is located on the outer surface of the top wall panel, and the area between the electrode edge corresponding to the location where the edge of the other electrode is located on the outer surface of the bottom wall panel.

In this excimer lamp of the invention, it is desirable for the UV-reflecting film to be on the inner surface area of the end wall panels as well.

In the excimer lamp of the invention, since a UV-reflecting film is formed on the inner surface of the discharge vessel, a portion of the UV radiation which is generated inside the discharge vessel and emitted in directions other than the direction of the light exit window by being reflected by the UV-reflecting film, together with the UV radiation emitted directly in the direction of the light exit window, can be emitted from the light exit window, and furthermore, this UV-reflecting film has a specified composition, and in addition, prevents the occurrence of abnormal discharge by being formed, at least, on the inner surface area of the side wall panels on the inner surface of the discharge vessel, and since, inside the discharge vessel, a countless number of columnar arc discharges having nearly uniformly identical discharge power can be generated, it can prevent the occurrence of abnormal discharge resulting in unevenness in illuminance on the target surface of the target body and the occurrence of peeling of the end area of the UV-reflecting film, so that UV radiation can be irradiated with a high degree of efficiency and furthermore, together with the target surface of the target body being able to be irradiated with a high degree of uniformity, occurrence of peeling of the UV-reflecting film can be prevented with th excimer lamp according to the invention.

(Optimum Form for Implementing the Invention)

Below, the excimer lamp of the present invention is explained in detail with reference to the accompanying drawings.

DETAILED DESCRIPTION OF THE INVENTION

Figure 1:
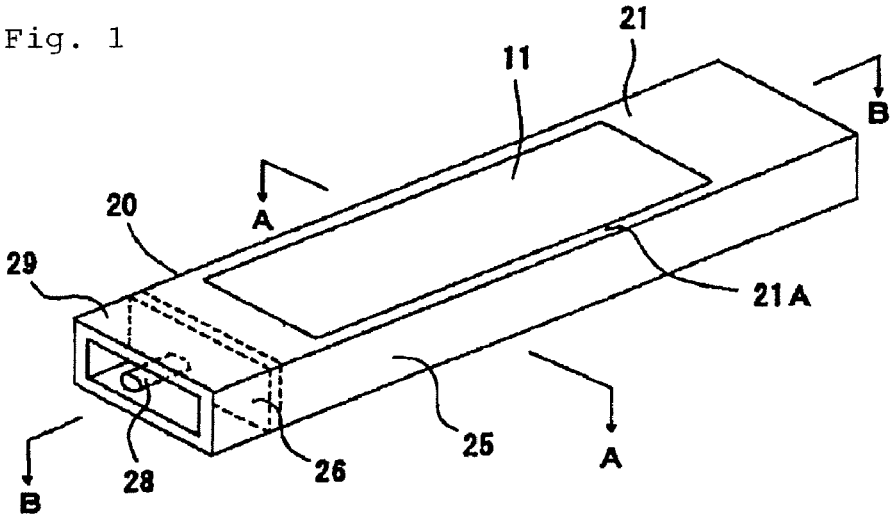
FIG. 1 is a perspective drawing showing an example of the structure of the excimer lamp of the invention.
Figure 2:
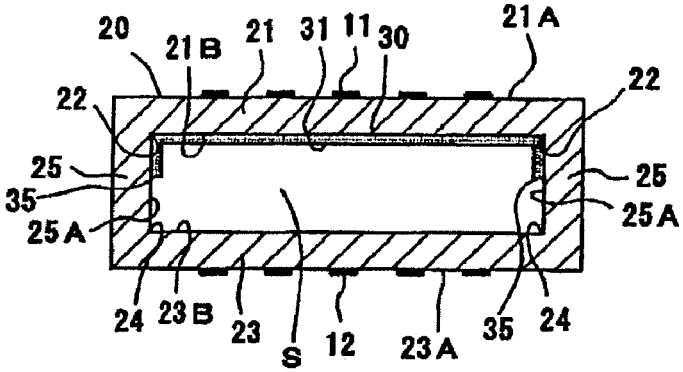
FIG. 2 is a sectional view taken along line A-A of the excimer lamp shown in FIG. 1.
Figure 3:
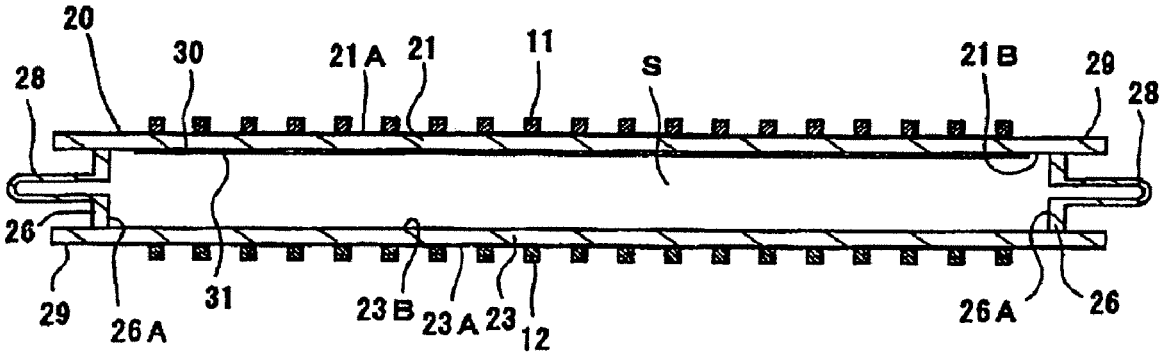
FIG. 3 is a sectional view taken along line B-B of the excimer lamp shown in FIG. 1.

FIG. 1 is a perspective drawing that shows an example of the configuration of the excimer lamp of the invention; FIG. 2 is a drawing that shows the A-A cross-sectional area of the excimer lamp in FIG. 1; FIG. 3 is a drawing that shows the B-B cross-sectional area of the excimer lamp in FIG. 1.

Both ends of this excimer lamp are hermetically sealed and it is provided with a nearly cylindrical-shaped silica glass discharge vessel 20 whose inside forms the discharge space S.

This discharge vessel 20 is bounded by a top wall panel 21, a bottom wall panel 23 facing the top wall panel 21, a pair of side wall panels 25 connecting the top wall panel 21 and the bottom wall panel 23, and a pair of end wall panels 26 installed so as to hermetically seal both ends of a square cylinder-shaped body. The top wall 21, bottom wall 23 and pair of side wall panels 25 enclose a nearly square column-shaped internal a discharge space S, in which is disposed a discharge gas, such as, for example, xenon, in which excimer molecules are formed by dielectric barrier discharge.

In the example shown in this drawing, discharge vessel 20 has a chip tube 28 and a flange 29. Also, 40 kPa of xenon gas is enclosed in the discharge space S as the discharge gas.

On this discharge vessel 20, a reticular electrode (hereafter referred to as "an electrode") 11 comprised of electrically conductive material, such as wire mesh, for example, is arranged on the outer surface 21A of top wall panel 21, together with another reticular electrode (hereafter referred to as "another electrode") 12, comprised of electrically conductive material, such as wire mesh, for example, and arranged on the outer surface 23A of bottom wall panel 23 and these electrodes 11, 12 are installed opposite from each other.

These electrodes 11, 12 are formed by vacuum evaporation of such metals as, for example, gold (Au) and also, are connected to an appropriate high frequency power supply (not shown).

On the inner surface of the discharge vessel 20 of this excimer lamp, a UV-reflecting film 30 of, for example, 10-1000 μm thickness, is formed at least on the inner surface area of the side wall panels, and furthermore, a light exit window for emitting UV radiation generated in discharge space S is formed in an area on the inner surface of the discharge vessel 20 where there is no UV-reflecting film 30.

Here, "the inner surface area of the side wall panels" means the inner surface 25A of the side wall panels 25 facing the discharge space S. Also, in order to connect the edge 22 of the flat top wall panel 21 to the edge 24 of the flat bottom wall panel 23, the side wall panels 25 are installed in the area between them and constitute wall panels of the discharge vessel 20.

It is not necessary for a UV-reflecting film 20 to be formed on the entire inner surfaces 25A of side wall panels 25 and, as far as the design specifications of the excimer lamp go, it should be formed on an area of said inner surfaces 25A, and furthermore, if that area is formed on the inner surfaces 25A of the side wall panels 25, it may also be formed on the inner surfaces of other wall panels constituting the discharge vessel 20 (specifically, the top wall panel 21, the bottom wall panel 23 and the end wall panels 26).

In the example in this Figure, the UV-reflecting film 30 is formed on the inner surface 21B of the top wall panel 21 and the upper wall panel side areas of the inner surfaces 25A (upper area in FIG. 2 of the side wall panels 25 of discharge vessel 20; in other words, so as to stretch across the area from the upper wall panel area of one (right side in FIG. 2) side wall panel side area 25, to the upper wall panel side area of the other (left side in FIG. 2) side wall panel 25, including the inner surface 21B of the top wall panel 21. Also, a light exit window is formed by an area on the inner surface of the discharge vessel 20, specifically, the bottom wall panel area (lower area in FIG. 2 of the bottom wall panel 23) and the side wall panels 25, where no UV-reflecting film is formed.

The UV-reflecting film 30 is comprised of silicon oxide (silica) and aluminum oxide (alumina) particles and these silica and alumina particles (hereafter referred to collectively as "specified UV scattering particles") are laminated.

Emitted UV radiation is refracted and reflected on the surfaces of numerous specified UV scattering particles by the UV-reflecting film 30, and consequently, they are scattered in directions different from the direction from which they were radiated.

The proportion of silica particles contained in the UV-reflecting film 30 is at least 30 weight % and preferably 30-99 weight %, and more preferably, 40-99 weight %. On the other hand, the proportion of the alumina particles that are contained is preferably 1-70 weight %, even more preferably 5-70 weight % and most preferably 10-70 weight %.

When the proportion of silica particles contained in the UV-reflecting film is below 30 weight %, the UV-reflecting film cannot get enough adhesion to the discharge vessel, and furthermore, as also became apparent from the experiment mentioned below, peeling occurs on the UV-reflecting film obtained.

The silica particles of which the UV-reflecting film 30 is comprised, may either be in a glassy state or a crystalline state, but particles in a glassy state are preferable.

It is desirable for the particle diameter of silica particles to be 2 to 8 μm and furthermore, it is desirable for the mean particle diameter to be 4 μm.

These silica particles, as well as having a high degree of UV reflectivity, are made from the same material as the discharge vessel 20 and have a high degree of adhesion to both the discharge vessel 20 and the alumina particles. Therefore, the UV-reflecting film 30, which is made from these silica particles, has a high degree of adhesion to the discharge vessel 20.

The alumina particles used in the UV-reflecting film 30 are normally crystallized, since they have the characteristic of being easy to crystallize and difficult to change to a glassy state.

It is desirable for the particle diameter of the alumina particles to be about 2 to 6 μm and also, it is desirable for the mean particle diameter to be 4 μm.

Compared to silica particles, the index of refraction of alumina particles is greater, and since, therefore, they have the characteristic of having a high degree of reflectivity, the UV-reflecting film which, together with silica particles, is composed of alumina particles having this kind of special quality has an excellent UV-reflecting capability.

Here, the particle diameter and mean particle diameter of silica particles and alumina particles is explained.

In this description, "particle diameter" is obtained as follows: the particles' size and number are measured on a microscope screen, and then, based on this, the particle size distribution is measured with the microscope image forming method; the distance between two parallel lines running in a fixed direction between which fits any particle on the enlarged image projected by the electron microscope is the Feret diameter.

When this particle diameter is measured in the UV-reflecting film manufacturing stage, the part equivalent to a globular part in the starting material, including when the silica particles melt and form clumps, is considered to be a particle. Also, when particles are piled on top of each other and some of their boundaries cannot be determined and a particle cannot be fitted between the two parallel lines, the Feret diameter is considered to be the distance between two perpendicular lines into which a particle fits.

Furthermore, "mean particle diameter" means using, for example, a Hitachi field emission scanning electron microscope (S4100) and measuring the particle diameter of over one hundred particles under the conditions of 10 to 20 kV acceleration voltage (when magnification is 20,000 times for particles with a diameter of 0.3 μm, for example) and calculating the distribution (counting) of the value of the measurement of the particle diameters and the mean range where the incidence is at its greatest. This mean value, regarded to be the mean particle diameter, is obtained, for example, by dividing the range between the maximum value and the minimum value of the measured particle diameters into 15 zones and considering the number of particle diameters belonging to each of the zones to be the number of said zone; the mean value is the value of the zone with the largest number among these 15 zones.

This kind of UV-reflecting film 30 can be formed by the following steps, for example, in the flow-down method, specifically, by combining silica particles and alumina particles with a suitable solvent and obtaining a reflecting film forming liquid; then by pouring this reflecting film forming liquid into the area where the UV-reflecting film 30 is to be formed on the inner surface of the discharge vessel tube for forming the discharge vessel 20, a thin layer is formed and by drying and calcinating this thin layer, it can be formed. In this method, by controlling the viscosity of the liquid, the thickness of the resulting UV-reflecting film 30 can be adjusted; specifically, in order to make it thinner, the viscosity of the liquid is lowered, and also, in order to make it thicker, the viscosity of the liquid is increased.

An excimer lamp constructed as above has a discharge vessel 20 and a UV-reflecting film 30 that functions as a dielectric by having an appropriately sized, controlled high frequency voltage from a high frequency power source applied between electrode 11 and electrode 12, and in discharge space S, discharge starting points occur on the surfaces (specifically, the surface 31 of UV-reflecting film 30 and the inner surface 23B of bottom wall panel 23 facing the UV-reflecting film 30 and the discharge space S of the bottom wall panel 23 opposite this UV-reflecting film 30 and, as a result of this, dielectric barrier discharge occurs and by this dielectric barrier discharge, excimer molecules in the discharge gas are formed and UV radiation is emitted from the light exit window comprised of the bottom wall panel 23 and the bottom wall panel side areas of the side wall panels 25 of the discharge vessel 20.

Since there is a UV-reflecting film 30 on the inner surface of the discharge vessel 20 in this excimer lamp, UV radiation generated in the discharge space S and emitted in the direction of the UV-reflecting film 30 and in directions other than the direction of the light exit window can be emitted from the light exit window by being reflected by said UV-reflecting film 30, together with the UV radiation radiated directly in the direction of the light exit window.

Moreover, this UV-reflecting film 30 contains a specified proportion of silica particles and alumina particles and, moreover, extends not only to the inner surface area of the top wall panel (the inner surface 21B of top wall panel 21) on the inner surface of the discharge vessel 20, but as far as the inner surface area of the side wall panel (the inner surface 25A of side wall panel 25) that connects the inner surface area of the top wall panel and this end area 35, and by being located on said inner surface area of the side wall panel, prevents the occurrence of abnormal discharge and, in discharge space S, almost uniformly generates a large number of columnar arc discharges with the same discharge power. As a result, the generation of abnormal discharges causing the unevenness in illuminance on the target surface of the target body that and peeling of the end area 35 of the UV-reflecting film 30 can be prevented.

Accordingly, since, through the excimer lamp of the invention, some of the UV radiation emitted in directions other than that of the light exit window can now be emitted from the light exit window through the functioning of the UV-reflecting film 30, UV radiation can be emitted with a high degree of efficiency, and furthermore, since the generation of abnormal discharges is prevented, the target surface of the target body can be irradiated with a high degree of uniformity, and peeling of the end area 35 of said UV-reflecting film 30 can be prevented.

Here, the reason why the occurrence of abnormal discharge is prevented in this excimer lamp invention may be assumed in the following.

Figure 10:
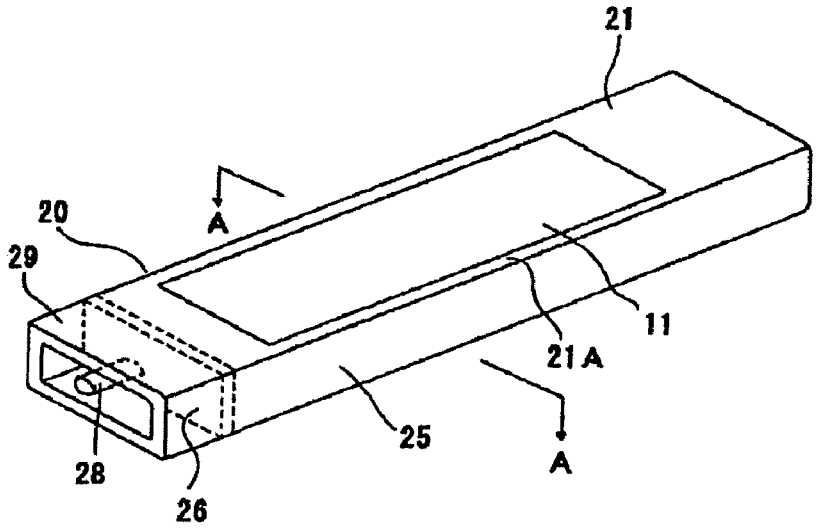
Fig. 10 (Prior Art)
FIG. 10 is a sectional view showing an example of the structure of an existing excimer lamp.
Figure 11:
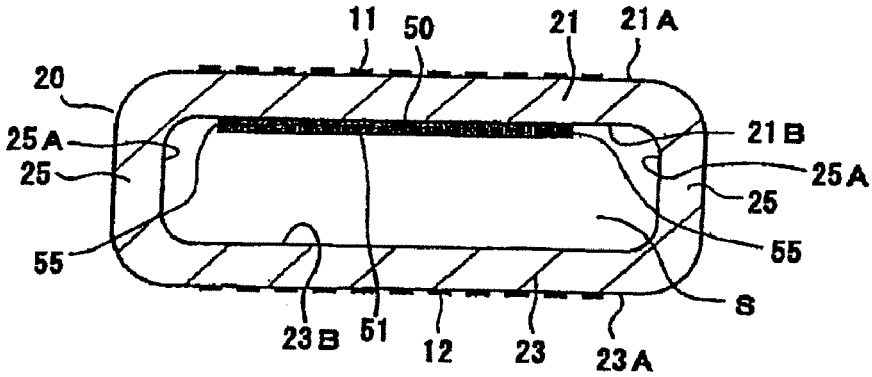
Fig. 11 (Prior Art)
FIG. 11 is a sectional view taken along A-A of the excimer lamp in FIG. 10.
Figure 12:
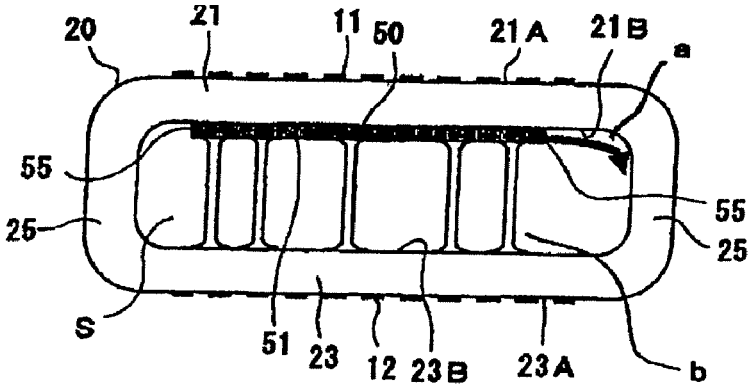
Fig. 12 (Prior Art)
FIG. 12 is a sectional view corresponding to that of FIG. 11, but showing the excimer lamp of FIG. 10 in a switched-on state.

As shown in FIGS. 10 & 11, when there is a UV-reflecting film 50 on only the inner surface 21B (inner surface area of the top wall panel) of the top wall panel 21, and considering the ends 55 of the UV-reflecting film 50 to be starting points, abnormal discharges occur towards the side wall panels 25 and one cause may be that electrical charges accumulate in the ends 55 of the UV-reflecting film 50 directly underneath one electrode 11. Moreover, if one considers these abnormal discharges to be a type of creeping discharge, another cause may be that the inner surface of the glass (inner surface of discharge vessel 20) is a mirror.

Also, in the excimer lamp of this invention, the UV-reflecting film 30 extends not only to the inner surface 21B of the top wall panel 21, but also to the inner surfaces 25A (inner surface area of the side wall panel) of the side wall panels 25 and since the ends 35 are not located directly underneath the electrode 11, the accumulation of electrical charge in said ends 35 is neutralized, resulting in a state in which it is considered to be difficult for abnormal discharges per se to occur. Furthermore, the surface of the UV-reflecting film 30 has an unevenness that arises from its constituent particles, and it may be that, since the creeping distance is also lengthened, a state occurs in which abnormal discharges per se are difficult.

However, this invention is not limited to the above example of an excimer lamp invention in accordance with the present invention and a variety of alterations can be utilized.

Figure 4:
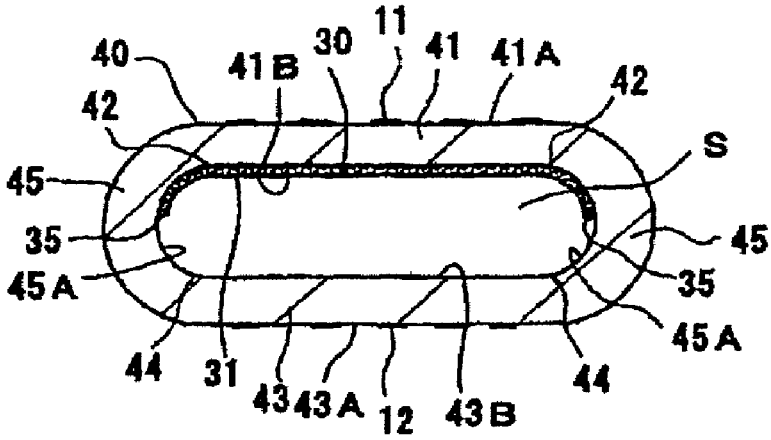
FIG. 4 is a sectional view showing another example of the structure of the excimer lamp of the invention.

For example, the discharge vessel that constitutes the excimer lamp can be comprised of a top wall panel, bottom wall panel, side wall panels and end wall panels that enclose the discharge space, and as shown in FIG. 4, the side wall panels 45 may not be flat like the other structural wall panels (specifically, the top wall panel 41, the bottom wall panel 43 and the end wall panels 46) and its cross-sectional shape may consist of curved panels with curved surfaces. Apart from being fitted with the discharge vessel 40, which has curved side wall panels 45, instead of the discharge vessel 20, this excimer lamp has the same structure as the excimer lamp in FIG. 1.

In other words, in this excimer lamp, as in the excimer lamp in FIG. 1, one electrode 11 and another electrode 12 are set onto the outer surface 41A of the top wall panel 41 and the outer surface 43A of the bottom wall panel 43 respectively. Also, a UV-reflecting film 30 is formed on the inner surface of the discharge vessel 40, so as to stretch from one (right side in FIG. 4) top wall panel side area (upper area in FIG. 4) on the inner surfaces 45A of the side wall panels 45, including the inner surface 41B of the top wall panel 41 and the area extending across to the other top wall panel side area (left side in FIG. 4) of the inner surfaces 45A of the side wall panels 45.

In this discharge vessel 40, in order to connect the edge 42 of the flat top wall panel 41 to the edge 44 of the flat bottom wall panel 43, the side wall panels 45 are installed in the area between them and constitute wall panels of the discharge vessel 40.

Furthermore, the UV-reflecting film on the inner surface of the discharge vessel scan be formed, at least, on the inner surface area of the side wall panel, and, as shown in FIGS. 5-9, it may be formed in a variety of areas. In any of these excimer lamps as shown in FIGS. 5-9, the same functionality as the excimer lamp in FIG. 1 can be obtained.

Figure 5:
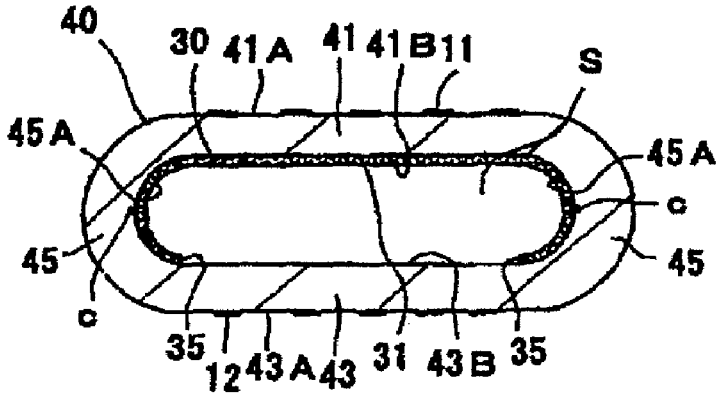
FIG. 5 is a sectional view showing yet another example of the structure of the excimer lamp of the present invention.

The example of an excimer lamp in FIG. 5 is provided with a discharge vessel 40 that has a side wall panel 45 consisting of a curved panel and other than being formed in the area mentioned below, the UV-reflecting film 30 has a structure identical to that of the excimer lamp in FIG. 4.

In this excimer lamp, the UV-reflecting film 30 is formed so as to stretch across the area of the inner surface of discharge vessel 40, from one side wall panel side area (right side area in FIG. 5) on the inner surface 43B of the bottom wall panel 43, to the other (left side in FIG. 5) side wall panel side area (left side area in FIG. 5 on the inner surface 43B of said bottom wall panel 43, including the inner surface 45A of the side wall panel 45 and the inner surface 41B of the top wall panel 41. In this excimer lamp, a light exit window is formed by an area where the UV-reflecting film on the bottom wall panel 23 is not formed on the inner surface 40 of the discharge vessel 40.

In an excimer lamp with this kind of structure, the electrodes 11, 12 are not formed on the discharge vessel 40 and due to the absence of columnar arc discharge in the area (specifically, in area c of the side wall panel 45) where the temperature is low compared to other areas, UV radiation deformation often occurs due to UV irradiation, but through the effect of the UV-reflecting film 30, this area c is not irradiated with UV radiation and so the occurrence of UV deformation in area c of discharge vessel 40 is prevented and, as a result, damage to the discharge vessel 40 due to UV radiation deformation can be controlled.

That is to say, even though the UV radiation generated in the vertical direction (right-left direction in FIG. 5) of the tube axis of the excimer lamp in discharge space S are irradiated integrally in the direction facing area c of the side wall panel 45, since the UV-reflecting film 30 is formed on the surface facing the discharge space S of this area c, UV radiation emitted in the direction facing area c are reflected by the UV-reflecting film 30 and this area c is not irradiated.

Figure 6:
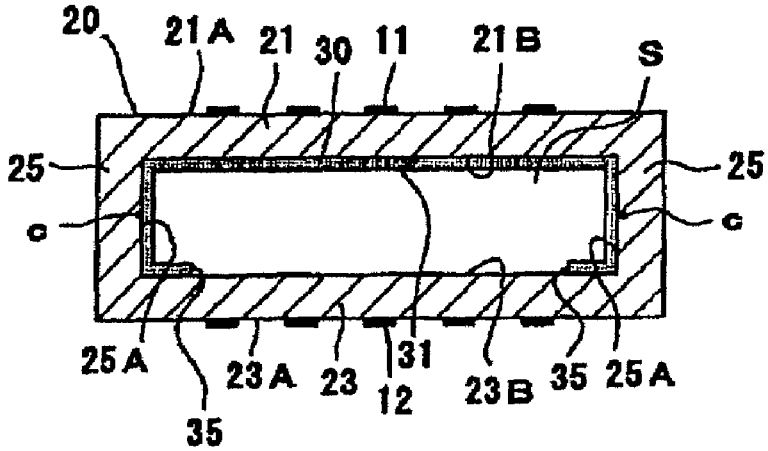
FIG. 6 is a sectional view showing yet another example of the structure of the excimer lamp the present invention.

Other than being fitted with discharge vessel 20, which has a flat side wall panel 25), instead of the discharge vessel 40 in the example excimer lamp in FIG. 5, the example excimer lamp in FIG. 6 has the same structure as said excimer lamp in FIG. 5.

In this excimer lamp, the UV-reflecting film 30 is formed so as to stretch across the area from one side wall panel side area (right area in FIG. 6) on the inner surface 23B of the bottom wall panel 23 to the other side wall panel side area (left side area in FIG. 6) on the inner surface 23B of said bottom wall panel 23, including the inner surface 25A of side wall panel 25 and the inner surface 21B of top wall panel 21 on the inner surface of discharge vessel 20.

Figure 7:
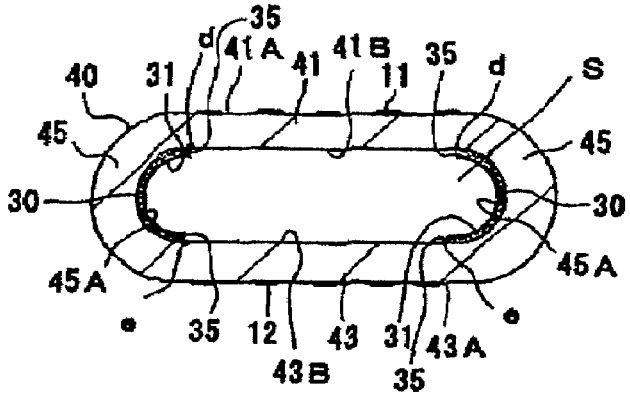
FIG. 7 is a sectional view showing yet another example of the structure of the excimer lamp the present invention.

The example excimer lamp in FIG. 7 is fitted with a discharge vessel 40 which has side wall panels 45 formed by curved panels and, other than the UV-reflecting film 30 being formed in the area mentioned below, it has the same structure as the excimer lamp in FIG. 4.

In this excimer lamp, the UV-reflecting film 30 is formed in each of the two areas; from the electrode edge opposing location d opposite the location of the edge of the electrode 11 on the outer surface 41A of the top wall panel 41, to the electrode edge opposing location e opposite the location of the edge of the other electrode 12 on the outer surface 43A of the bottom wall panel 43 on the inner surface of the discharge vessel 40

More specifically, one UV-reflecting film 30 is formed so as to stretch across an area from the side wall panel side area of a side (right side in FIG. 7) of the inner surface 41B of the top wall panel 41, to a side wall panel side area (right side area in FIG. 7) of the inner surface 43B of the bottom wall panel 43, including the inner surface 45A of the side wall panel 45. Also, the other UV-reflecting film 30 is formed so as to stretch across an area from the side wall panel side area of the other side (left side in FIG. 7) of the inner surface 41B of the top wall panel 41, to the side wall panel side area of the other side (left side area in FIG. 7) of the inner surface 43B of the bottom wall panel 43, including the inner surface 45A of the side wall panel 45. In this excimer lamp, separate light exit windows are formed by the two areas on the top wall panel 41 and the bottom wall panel 43 respectively where no UV-reflecting film 30 is formed on the inner surface of the discharge vessel 40.

Moreover, in excimer lamps fitted with discharge vessels formed of flat-shaped side wall panels, as in the excimer lamp in FIG. 7, a UV-reflecting film can be formed between each of the two areas from the electrode edge opposing location opposite the location of the edge of a electrode on the outer surface of the top wall panel to the electrode edge opposing location opposite the location of the edge of the other electrode on the outer surface of the bottom wall panel.

Figure 8:
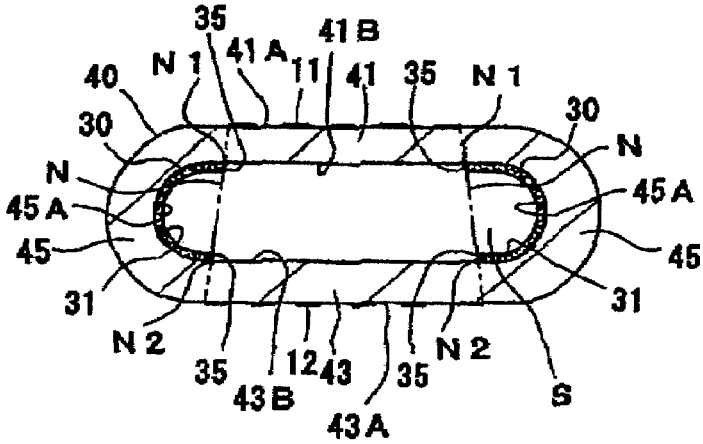
FIG. 8 is a sectional view showing yet another example of the structure of the excimer lamp the present invention.

The example of an excimer lamp in FIG. 8 shows a discharge vessel 40 which has side wall panels 45 comprised of curved panels and, other than having the UV-reflecting film 30 in the area mentioned below, has the same structure as the excimer lamp in FIG. 4.

In this excimer lamp, the UV-reflecting film 30 is on the inner surface of discharge vessel 40 and, in a cross-area perpendicular to the tube axis of the excimer lamp of said discharge vessel 40, is formed in each of the two areas located on the outer side (right and left sides in FIG. 8) of the straight lines (N) linking both the ends of one electrode 11 and the other electrode 12.

More specifically, a UV-reflecting film 30 is formed to stretch across the area from the point of intersection N1 (right side of FIG. 8) with a straight line N on the inner surface 41B of the top wall panel 41, to the point of intersection N2 with the straight line N on the inner surface 43B of the bottom wall panel 43, including the inner surface 45A of the side wall panels 45. Also, the other UV-reflecting film 30 is formed so as to stretch across the area from the point of intersection (N1) (left side of FIG. 8) with the other straight line N on the inner surface 41B of top wall panel 41, to the point of intersectional N2 with the other straight line N on the inner surface 43B of the bottom wall panel 43, including the inner surface 45A of side wall panel 45. In this excimer lamp, separate light exit windows are formed by each of the two areas of the top wall panel 41 and the bottom wall panel 43 where UV-reflecting film 30 is not formed.

Also, in an excimer lamp provided with a discharge vessel with flat side wall panels, as in the excimer lamp in FIG. 8, UV-reflecting films on the inner surface of the discharge vessel and in a cross-area perpendicular to the tube axis of said discharge vessel of the excimer lamp are formed in the two respective areas located on the outer side of the straight lines linking the end areas of both the one electrode and the other electrode.

Figure 9:
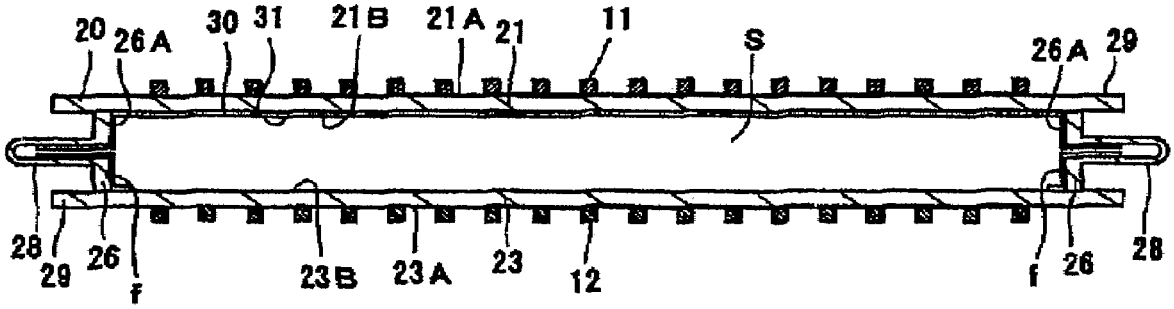
FIG. 9 is a sectional view showing yet another example of the structure of the excimer lamp the present invention.

The example of an excimer lamp in FIG. 9 is provided with a discharge vessel 20 which has a flat side wall panel 25) and the UV-reflecting film 30 has a structure which is also formed on the inner surface area of the end wall panels (the inner surface 26A of the end wall panels 26) on the inner surface of the discharge vessel 20.

More specifically, this excimer lamp, other than having the UV-reflecting film 30 on the entire inner surface 25A of side wall panel 25 and the inner surfaces 26A of the end wall panels 26 and both ends of the end wall panel 26 sides of the inner surface 23B of the bottom wall panel 23, has the same structure as the excimer lamp in FIG. 1.

In an excimer lamp with this kind of structure, electrodes 11 and 12 are not formed on discharge vessel 20, and UV radiation deformation often occurs, due to the irradiation of UV radiation in the area where the temperature is low compared to other areas (specifically, area f in end wall panel 45), due to the absence of columnar arc discharge, but, since, due to the operation of the UV-reflecting film 30, UV radiation is not irradiated on this area f, the occurrence of UV stress in area f of discharge vessel 20 is prevented and, as a result, the occurrence of damage in discharge vessel 20 due to UV deformation can be prevented.

That is to say, in the direction facing area f of end wall panels 26), even though UV radiation in the discharge space S is integrally emitted perpendicularly (right-left direction in FIG. 9) to the tube axis of the excimer lamp, since the UV-reflecting film 30 is on the surface of this area f facing the discharge space S, UV radiation irradiated in the direction towards area f is reflected by the UV-reflecting film 30 and area f is not irradiated.

Below, is a description of an example experiment carried out in order to confirm the effectiveness of this invention.

EXAMPLE EXPERIMENT 1

Following the structure in FIG. 1, 10 of each of 6 types of excimer lamps were made having a UV-reflecting film with a thickness of 22 μm was made of both silica particles with a mean particle size of 4 μm and alumina particles with a mean particle size of 4 μm and having the composition shown in Table 1 below.

The excimer lamps manufactured were 904 mm long in total and the length of the width direction formed by both the side and end panels was 43 mm and the length of the height direction formed by both the top wall panel and the bottom wall panel was 15 mm. The lamps were fitted with a discharge vessel made of silica glass with a thickness of 2.5 mm and a mesh electrode formed by vacuum evaporation of gold (Au), and the discharge vessel was filled with 40 kPa of xenon gas.

After switching on each of the resultant excimer lamps with 5 kV of high voltage alternating current, the presence of peeling in the UV-reflecting film was checked for by direct observation; if there was no occurrence of peeling in the UV-reflecting film of any of the 10 lamps, a "O" was marked; if there was occurrence of peeling in the UV-reflecting film of some of the 10 lamps, a "Δ" was marked; if there was peeling of the UV-reflecting film in all of the lamps, an "X" was marked. The results are shown in Table 1.

TABLE 1

| | Composition (Weight %) | | |
|---|---|---|---|
| | Silica particles | Alumina particles | Presence of peeling |
| Lamp 1 | 90 | 10 | ○ |
| Lamp 2 | 60 | 40 | ○ |
| Lamp 3 | 40 | 60 | ○ |
| Lamp 4 | 30 | 70 | ○ |
| Lamp 5 | 25 | 75 | Δ |
| Lamp 6 | 20 | 80 | X |

From the above results, it was confirmed that by putting a UV-reflecting film not only on the inner surface of the top wall panel, but also across the inner surface of the side wall panel and using silica particles having a percentage of 30 weight % or more in the UV-reflecting film, the occurrence of abnormal discharge, and consequently, the occurrence of peeling in the UV-reflecting film can be prevented.

Furthermore, by using silica particles having a percentage of 40 weight % or more, that is to say, using silica particles whose volume percentage is 54% or more, it was confirmed that a UV-reflecting film with excellent adhesiveness to the discharge vessel was obtained.

What is claimed is:

1. An excimer lamp having a silica glass discharge vessel containing a discharge gas which forms excimer molecules by dielectric barrier discharge, comprising:

a top wall panel and a bottom wall panel facing said top wall panel, a pair of side wall panels connecting said top wall panel and bottom wall panel and a pair of end wall panels connecting the top, bottom and side wall panels, an internal space enclosed by the top, bottom, side and end wall panels, a first electrode formed on an outer surface of the top wall panel, a second electrode formed on an outer surface of the bottom wall panel opposite said first electrode, and a UV-reflecting film comprised of silica particles and alumina particles formed on at least an inner surface area of the side wall panels, said silica particles constituting at least 30 weight % of the UV-reflecting film.

2. The excimer lamp mentioned in claim 1, wherein the UV-reflecting film is formed in an area extending from a location opposite where an edge of the electrode on the outer surface of the top wall panel is located, across the inner surface area of the side wall panels to a location opposite where an edge of the electrode on the outer surface of the bottom wall panel is located.

3. An excimer lamp according to claim 2, having a UV-reflecting film also on an inner surface area of the end wall panels.

4. An excimer lamp according to claim 1, having a UV-reflecting film also on an inner surface area of the end wall panels.

* * * * *